US006172595B1

(12) United States Patent
Komatsu et al.

(10) Patent No.: US 6,172,595 B1
(45) Date of Patent: Jan. 9, 2001

(54) RESISTOR EXCELLENT IN MICRO-LINEARITY CHARACTERISTIC AND WEAR RESISTANCE AND VARIABLE RESISTOR USING THE SAME

(75) Inventors: Hisashi Komatsu; Yoshihiro Taguchi; Takayuki Fujita; Katsuhisa Osada, all of Miyagi-ken (JP)

(73) Assignee: Alps Electric Co., Ltd., Tokyo (JP)

( * ) Notice: Under 35 U.S.C. 154(b), the term of this patent shall be extended for 0 days.

(21) Appl. No.: 09/577,774

(22) Filed: May 24, 2000

(30) Foreign Application Priority Data

May 25, 1999 (JP) ..... 11-145011

(51) Int. Cl.[7] ..... H01C 10/30

(52) U.S. Cl. ..... 338/160; 338/308; 252/511

(58) Field of Search ..... 338/160, 161, 338/311, 306–310; 252/511

(56) References Cited

U.S. PATENT DOCUMENTS

| | | | | |
|---|---|---|---|---|
| 5,111,178 | | 5/1992 | Bosze . | |
| 5,219,494 | * | 6/1993 | Ambros et al. | 252/511 |
| 5,475,359 | * | 12/1995 | Hatayama et al. | 338/160 |
| 5,781,100 | * | 7/1998 | Komatsu | 338/160 |

FOREIGN PATENT DOCUMENTS

| | | | | |
|---|---|---|---|---|
| 4-18703 | * | 1/1992 | (JP) | 338/160 |

* cited by examiner

*Primary Examiner*—Karl D. Easthom
(74) *Attorney, Agent, or Firm*—Brinks Hofer Gilson & Lione

(57) ABSTRACT

A variable resistor uses a carbon fiber-base resistor with a specific distribution of carbon particle sizes. Because the particle size distribution of carbon fiber is approximately equal to the normal distribution and 80% by volume or more carbon fiber is included in the particle size range from 1 to 20 μm, high conductivity in the fiber length direction of carbon fiber that is served as structural material for improving the wear resistance does not affect the micro-linearity.

5 Claims, 9 Drawing Sheets

$V_A$ : OUTPUT VALUE WHEN SLIDER IS POSITIONED AT POINT A ON RESISTOR $V_B$ : OUTPUT VALUE WHEN SLIDER IS POSITIONED AT POINT B ON RESISTOR $V_{in}$ : APPLIED VOLTAGE IN LONGITUDINAL L-DIRECTION OF RESISTOR $\Delta X$ : DISTANCE BETWEEN POINT A AND POINT B

L : RESISTOR LENGTH $\alpha$ : ARBITRARY INTERCEPT

RESISTOR EXCELLENT IN MICRO-LINEARITY CHARACTERISTIC AND WEAR RESISTANCE AND VARIABLE RESISTOR USING THE SAME

BACKGROUND OF THE INVENTION

1. Field of the Invention

This invention relates to a resistor excellent in micro-linearity characteristic and in wear resistance and a variable resistor that uses the resistor.

2. Description of the Related Art

A conventional resistor used for a variable resistor of various sensors contains resin serving as based material of the resistor, carbon fiber serving as structural material, and carbon black serving as conducting particle, and a slider moves in contact with a resistor pattern consisting of the resistor. At that time, because hard carbon fiber receives the load of the slider in the diametral direction and distributes the load along the long carbon fiber, the load wears the resistor very little. Therefore, the wear resistance of the variable resistor that uses this type of resistor is excellent in comparison with the variable resistor that uses another type of resistor that contains only conducting particles such as carbon black or graphite.

However, in the case of a conventional resistor that uses carbon fiber, because carbon fiber has high conductivity in the fiber direction, the resistivity varies in a small range of the resistor depending on the fiber orientation of carbon fiber, and the micro-linearity characteristic is poor, and the poor micro-linearity is a problem.

The micro-linearity characteristic is described herein under. FIG. 14 shows a graph obtained in a test. In the test, a rating voltage $V_{in}$ is applied in the length L direction of a resistor pattern, and the vertical axis represents the output V of a slider that slides on the resistor pattern in the longitudinal direction and the horizontal axis represents the position X of the slider on the resistor pattern. The output change concomitant with displacement ΔX of the slider from an arbitrary point on the resistor is represented by an ideal straight line P having a gradient $V_{in}/L$ on the assumption that the resistivity of the resistor is constant not depending on the position.

On the ideal straight line P, the normal output voltage obtained when the slider moves from A point to B point by ΔX is represented by $\Delta V=(\Delta X/L)\times V_{in}$, but the actual output S deviates from the ideal straight line P. As shown in the equation (1), the micro-linearity characteristic is calculated as described herein under. The normal output variation is subtracted from the output variation $V_A-V_B$ ($V_A$ is the actual output at the point A and $V_B$ is the actual output at the point B) to obtain the difference, the difference is divided by the applied voltage, and the obtained value is multiplied by 100 to obtain percent expression. In the case of high performance position sensor, particularly excellent micro-linearity characteristic, which shows actual output S is similar to the ideal straight line P, is required.

[Equation 1]
micro-linearity $$\frac{(V_B - V_A) - \left(\frac{\Delta X}{L}\right)V_{in}}{V_{in}} \times 100$$

$V_A$: output value obtained when the slider is positioned at the point A $V_B$: output value obtained when the slider is positioned at the point B $V_{in}$: applied voltage in the resistor length L direction ΔX: distance between the point A and the point B L: resistor length

SUMMARY OF THE INVENTION

The resistor in accordance with the present invention contains 15 to 20% by volume of carbon black and 15 to 20% by volume of carbon fiber in the resistor base material. The particle diameter distribution of the carbon fiber is approximately according to the normal distribution, and 80% by volume or more carbon fiber of the whole carbon fiber is included in the particle size range from 1 to 20 μm.

The material to be used as the resistor base material is not limited as long as carbon black and carbon fiber are dispersed homogeneously and bonded. For example, thermosetting resins such as phenol-aldehyde resin, xylene-modified phenol resin, epoxy resin, polyimide resin, melamine resin, acrylic resin, acrylate resin, and furfuryl resin may be used.

Carbon black functions to render the resistor conductive. The carbon black content in the resistor lower than 15% by volume results in low conductivity as the resistor and poor micro-linearity characteristic, and on the other hand the carbon black content of higher than 20% by volume results in poor screen printability of the resistor and poor moldability of the resistor pattern.

Carbon fiber functions to distribute the load exerted from a slider and support the slider. Therefore, carbon fiber is served as the structural material for improving the wear resistance of the resistor due to the load of a slider and also functions to stabilize the electrical contact with the slider of the resistor at the contact point.

The carbon fiber content in the resistor lower than 15% by volume results in reduced points that support the load of a slider and results in poor support, the wear resistance is reduced. On the other hand, the carbon fiber content of higher than 20% by volume results in poor bonding power of resin that is used as the base material of the resistor and carbon fiber leaves off from the resistor surface, and the wear resistance of the resistor is reduced.

The particle size distribution of carbon fiber is prescribed so that carbon fiber fills the above-mentioned role and renders the resistor excellent in micro-linearity. The percentage of carbon fiber in the particle size range from 1 to 20 μm of 80% by volume or lower, namely the case that the particle size distribution is broad or the case that the distribution curve deviates significantly from the normal distribution or is asymmetric distribution, in other words carbon fiber contains much carbon fiber having long length and/or much carbon fiber having short length, results in poor micro-linearity characteristic due to existence of long carbon fiber, and/or results in poor wear resistance due to existence of short carbon fiber that does not function to support the load of the slider.

In the resistor in accordance with the present invention, the particle size distribution of carbon fiber has the peak at the particle size in the range from 1 to 3 μm. The carbon fiber in accordance with the present invention is granular, the high conductivity of carbon fiber in the fiber length direction does not affect the micro-linearity. The granular carbon fiber receives the load of the slider on several groups, and the load is distributed to adjacent many carbon fibers, and the carbon fiber renders the resistor wear resistant.

In the case of another resistor in accordance with the present invention, the particle size distribution of carbon fiber has the peak at the particle size in the range from 6 to 10 μm. In the case of carbon fiber having short fiber length as described herein above, the high conductivity in the fiber length direction does not affect the micro-linearity characteristic, carbon fiber receives the load of a slider in the fiber diameter direction, the load is distributed along the fiber length direction, and the load is supported. Therefore, the resistor is excellent in wear resistance, and the performance is maintained in the various environmental temperatures.

The resistor in accordance with the present invention contains carbon fiber that is desirably subjected to coupling treatment. Silanate base, titanate base, or alumina base coupling agents may be used as the coupling agent. The dispersibility of carbon fiber in the resistor base material is improved by means of such coupling agent, carbon fiber is prevented from leaving off from the resistor surface, and the wear resistance is improved.

The resistor of the present invention is excellent in micro-linearity characteristic and wear resistance in a wide environmental temperature range, as the result, the variable resistor of the present invention is also excellent in these performances, and desirably used for the position sensor to be mounted on an engine controller of a vehicle.

DETAILED DESCRIPTION OF THE PREFERRED EMBODIMENTS

Preferred embodiments of the resistor in accordance with the present invention will be described in detail hereinafter. In the embodiment of the resistor of the present invention, the carbon black content in the resistor base material is 15 to 20% by volume and the carbon fiber content in the resistor base material is also 15 to 20% by volume. The particle size distribution of carbon fiber is approximately equal to the normal distribution, and 80% by volume of the whole distribution is included in the particle size range from 1 to 20 $\mu$m.

The carbon fiber as described herein above is obtained by grinding the commercially available carbon fiber (for example, Torayca MLD product of Toray, or Besfight HTA-CMF product of Toho rayon) having a fiber diameter of about 8 $\mu$m and mixed fiber length of 10 $\mu$m to 100 $\mu$m.

The ground carbon fiber is mixed with amino-silanate base coupling agent, water, and ethanol, stirred for 2 hr, and then filtered and dried at approximately 100° C. for completing coupling treatment.

Figure 1:
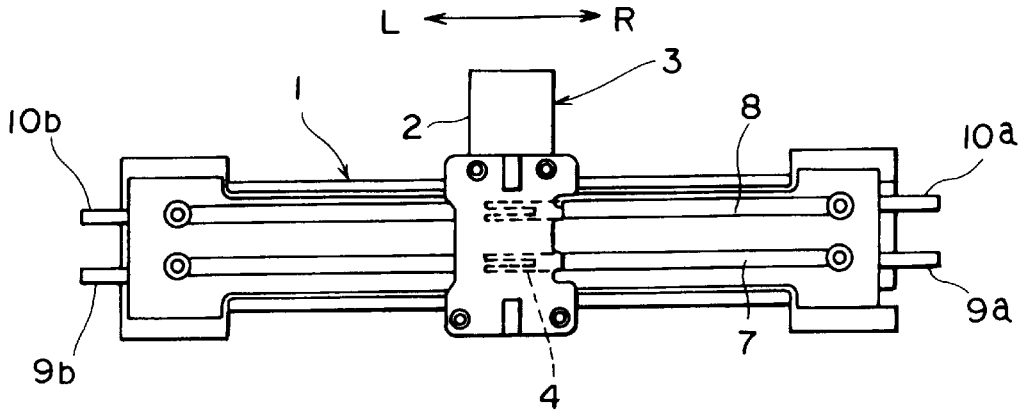
FIG. 1 is a plan view for illustrating one embodiment of a variable resistor in accordance with the present invention.
Figure 2:
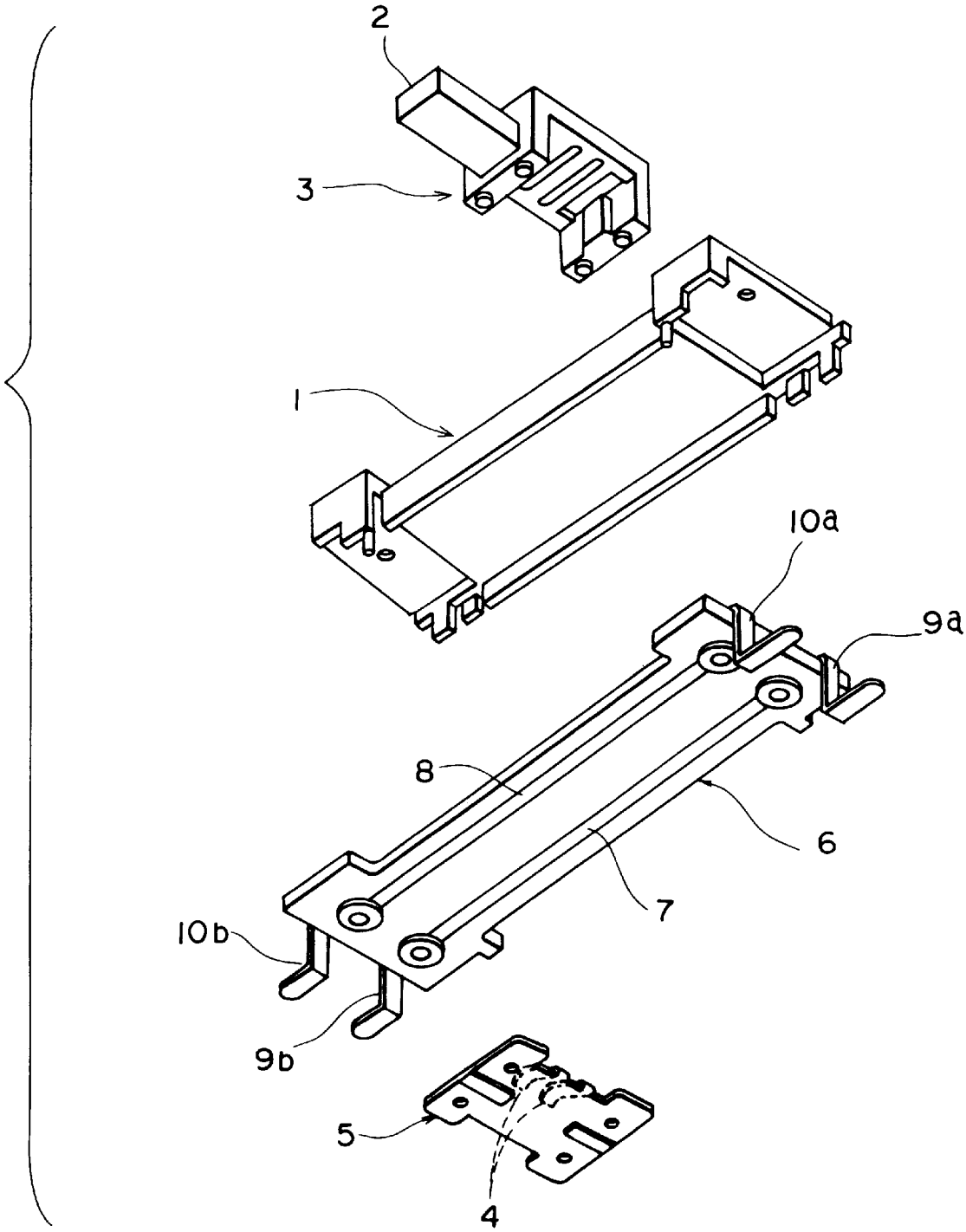
FIG. 2 is an exploded perspective view for illustrating the variable resistor shown in FIG. 1.

FIG. 1 is a whole plan view of an embodiment of the variable resistor in accordance with the resistor to which the resistor described herein above is applied, and FIG. 2 is an exploded perspective view of the variable resister. The variable resistor comprises a frame 1 consisting of insulative material having U-shaped cross section having the open bottom end and open both side ends, an operation member 3 having a lever 2 that is to be operated externally, an insulative stopper plate 5 formed combinedly with a pair of sliders 4, and an insulating board 6. On the insulating board 6, a resistor pattern 7 consisting of the resistor of the present invention formed by means of screen printing, a collector pattern 8 that extends along the resistor pattern 7, an input terminal 9*a* and an output terminal 9*b* that are connected to both ends of the resistor pattern 7, and an input terminal 10*a* and an output terminal 10*b* that are connected to both ends of the collector pattern 8 are formed.

The insulating board 6 is contained in the frame 1, the operation member 3 and the stopper plate 5 are disposed with interposition of the insulating board 6 and the fame 1, the sliders 4 of the stopper plate 5 is mounted together so as to contact-slide with the resistor pattern 7 and the collector pattern 8 respectively in the arrow directions L and R shown in FIG. 1. When the operation member 3 is slid in the arrow direction shown in FIG. 1 while a current and voltage is being applied between the input terminals 9*a* and 10*a*, the pair of sliders 4 are slid on the resistor pattern 7 and the collector pattern 8 concomitantly with the movement of the operation member 3. The conduction position between the pair of sliders 4 and the resistor pattern 7 and the collector pattern 8 varies, and the current and voltage output corresponding to the conduction position is obtained from the output terminals 9*b* and 10*b*.

EXAMPLE 1

In Example 1 of the resistor of the present invention, the resistor that contains 20% by volume of carbon black and 16% by volume of carbon fiber were dispersed in acetylene-end polyisoimide resin that was served as the resistor base material.

Figure 3:
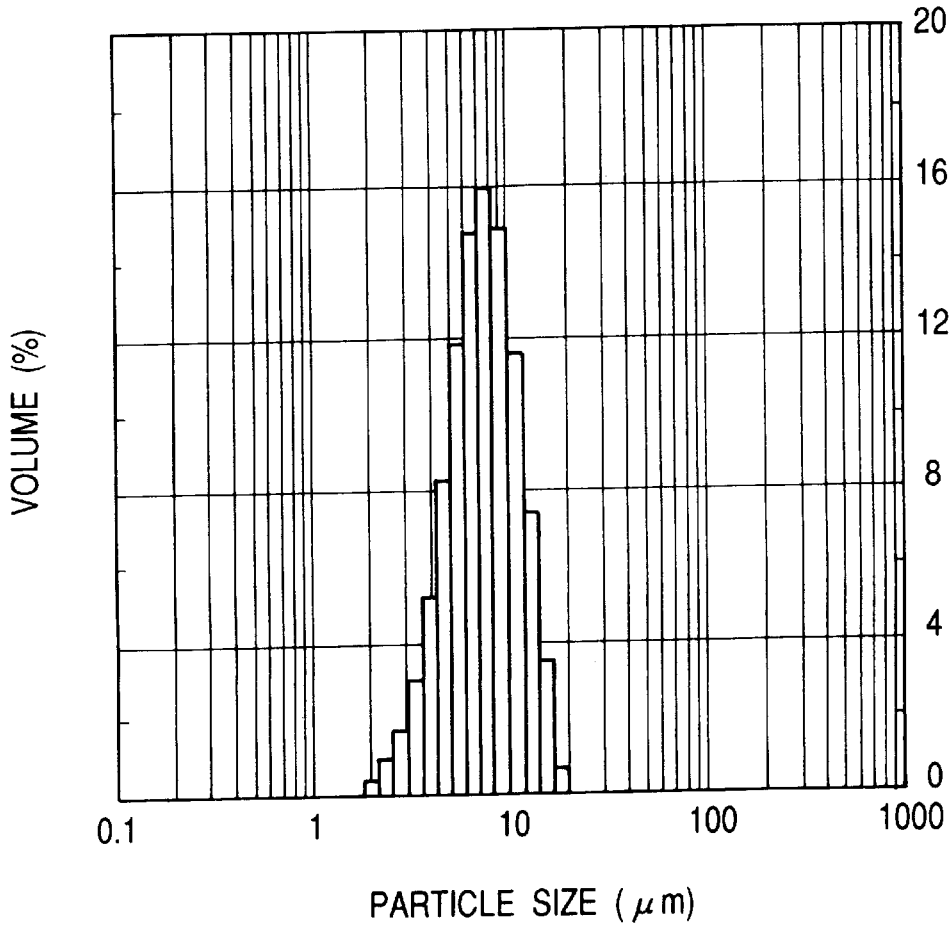
FIG. 3 is a graph for showing the particle size distribution of carbon fiber used in Example 1 of the resistor in accordance with the present invention.

FIG. 3 is a graph for showing the particle size distribution of carbon fiber used in Example 1 observed by means of laser diffraction-diffusion method, the horizontal axis represents the particle size ($\mu$m) and the vertical axis represents the proportion (% by volume) of the carbon fiber having the particle size at the position in the whole carbon fiber.

As obvious from FIG. 3, the particle size distribution of carbon fiber used in Example 1 has a peak at a particle size of approximately 8 $\mu$m and 90% by volume of carbon fiber is included in the particle size range from 5 to 13 $\mu$m. A commercially available carbon fiber was ground by means of jet mill grinding method, at that time the commercially available carbon fiber was charged at a rate of 1 to 3 g/min while compressed air of 6 to 7 kg/cm$^2$ was being fed at a rate of 0.2 to 0.6 m$^3$/min into a cyclone having a diameter of 150 mm.

Comparative Example 1

The resistor used in Comparative example 1 contains 15% by volume of carbon black and 16% by volume of carbon fiber dispersed in the same resistor base material as used in Example 1.

Figure 9:
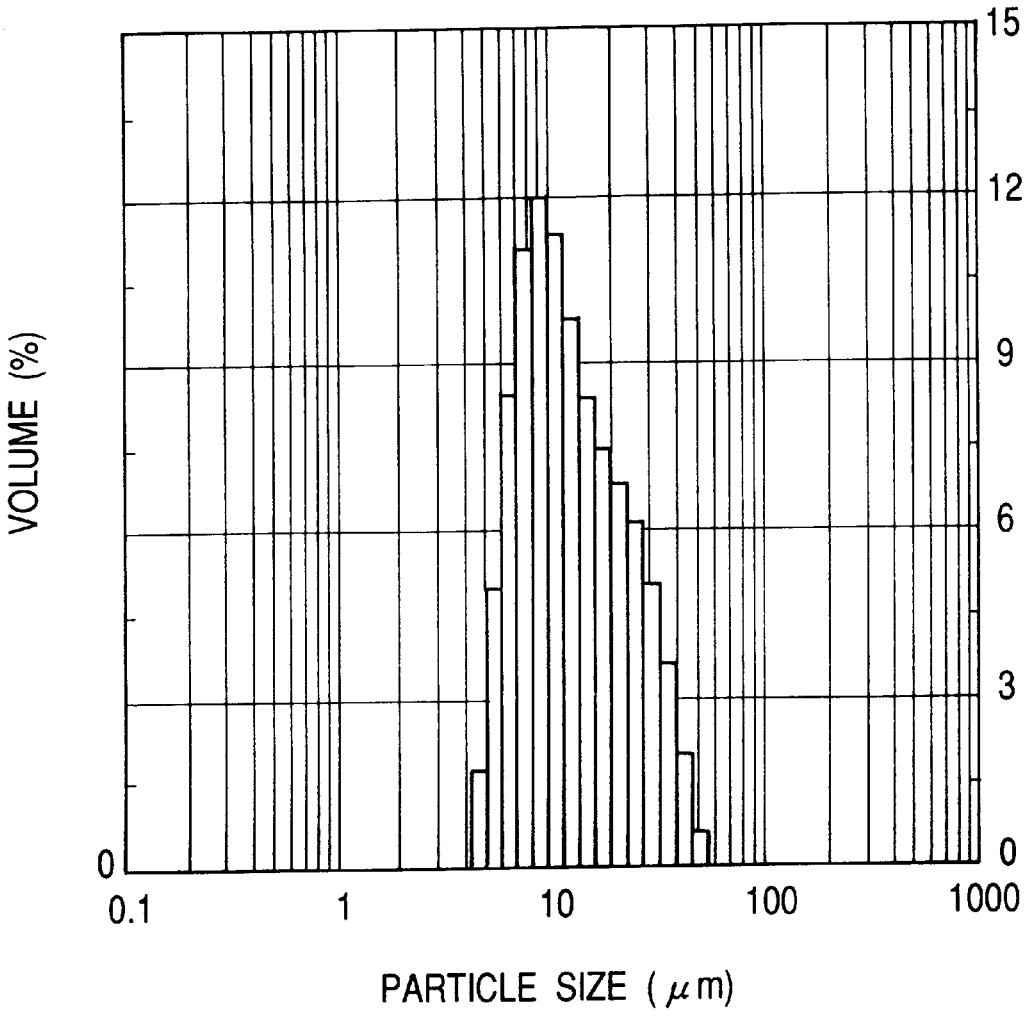
FIG. 9 PRIOR ART
FIG. 9 is a graph for showing the particle size distribution of carbon fiber used for the resistor of Comparative example 1.

FIG. 9 is a graph having the same coordinate axis system as used in FIG. 3 for showing the particle size distribution of carbon fiber used in Comparative example 1. As obvious from FIG. 9, the particle size distribution of carbon fiber used in Comparative example 1 is not according to the normal distribution and asymmetrical, and 90% by volume of carbon fiber is included in a particle size range of 50 $\mu$m.

Comparative Example 2

The resistor used in Comparative example 2 contains 20% by volume of carbon black dispersed in the same resistor base material as used in Example 1.

Figure 4:
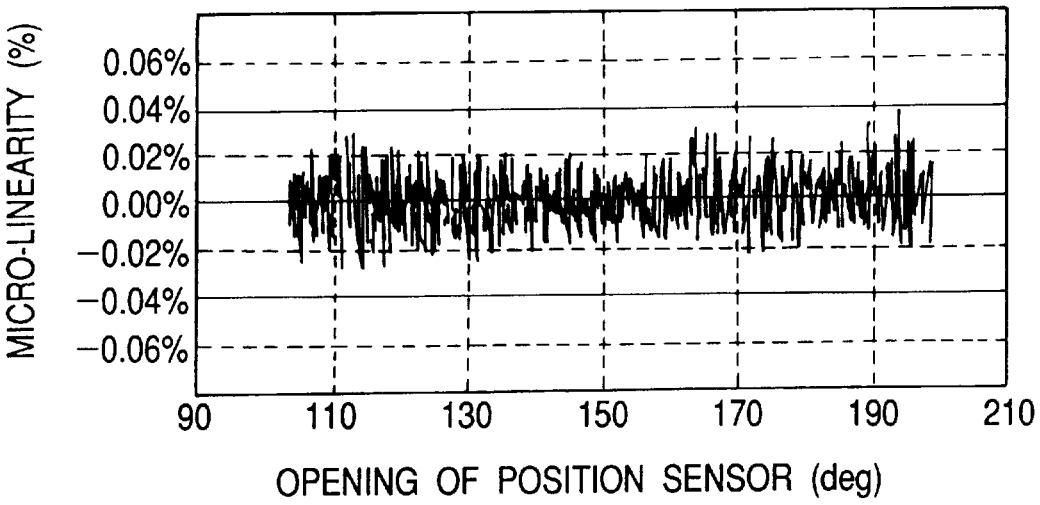
FIG. 4 is a graph for describing the micro-linearity characteristic of Example 1 of the resistor in accordance with the present invention.
Figure 10:
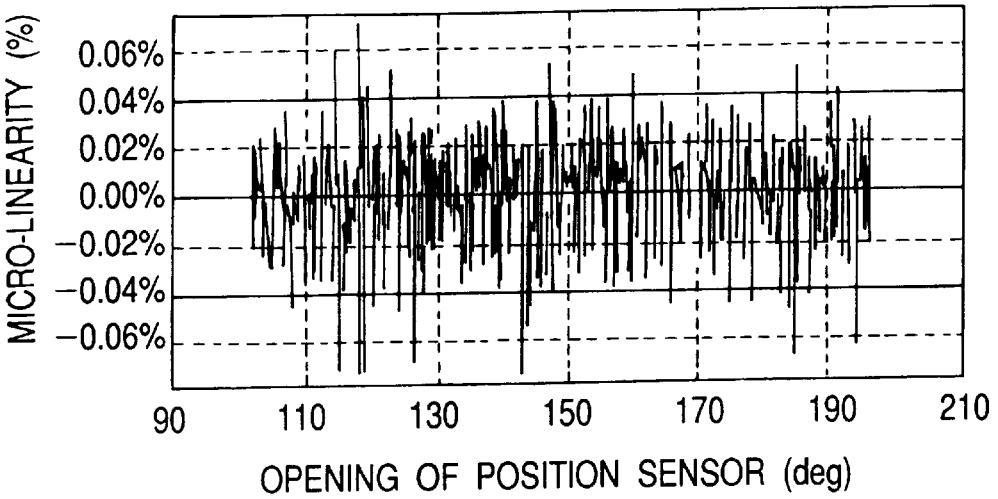
FIG. 10 PRIOR ART
FIG. 10 is a graph for describing the micro-linearity characteristic of Comparative example 1.
Figure 12:
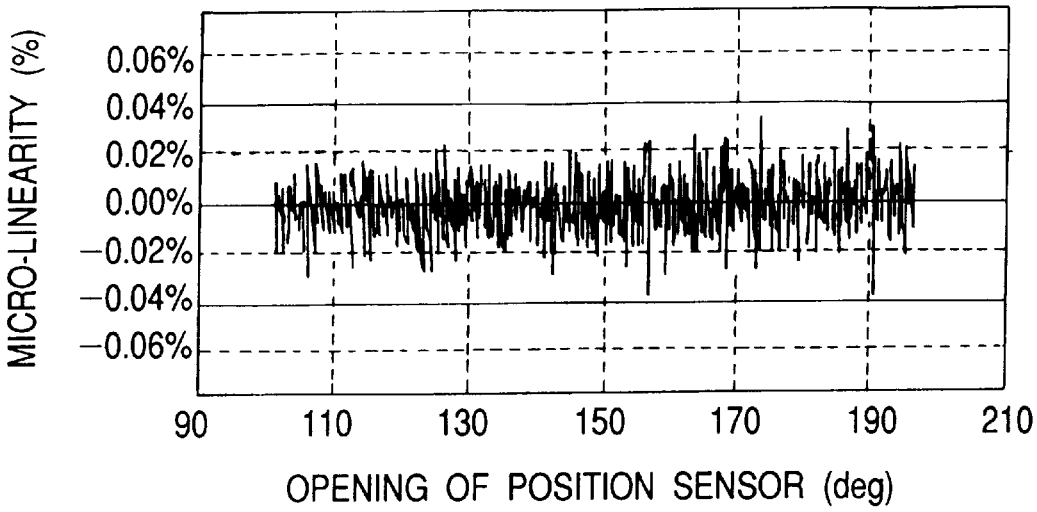
FIG. 12 PRIOR ART
FIG. 12 is a graph for describing the micro-linearity characteristic of Comparative example 2.

FIG. 4 shows the micro-linearity characteristic of Example 1. The horizontal axis of the graph shown in FIG. 4 represents the opening of a position sensor namely angle (degrees), and the vertical axis represents the micro-linearity (%). The micro-linearity characteristic of Comparative examples 1 and 2 are shown in FIG. 10 and FIG. 12 respectively. The horizontal axis and the vertical axis of FIG. 10 and FIG. 12 are the same as those of FIG. 4.

From the above-mentioned result, it is obvious that the micro-linearity characteristic of the resistor of Example 1 is significantly improved in comparison with Comparative example 1, and is approximately equal to the resistor of Comparative example 2 that contains no carbon fiber.

Figure 5:
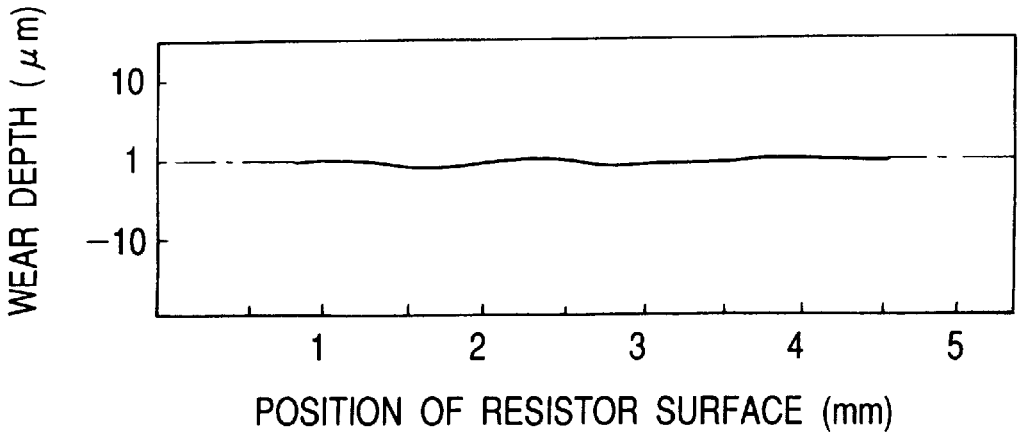
FIG. 5 is a graph for describing the wear resistance of Example 1 of the resistor in accordance with the present invention.
Figure 11:
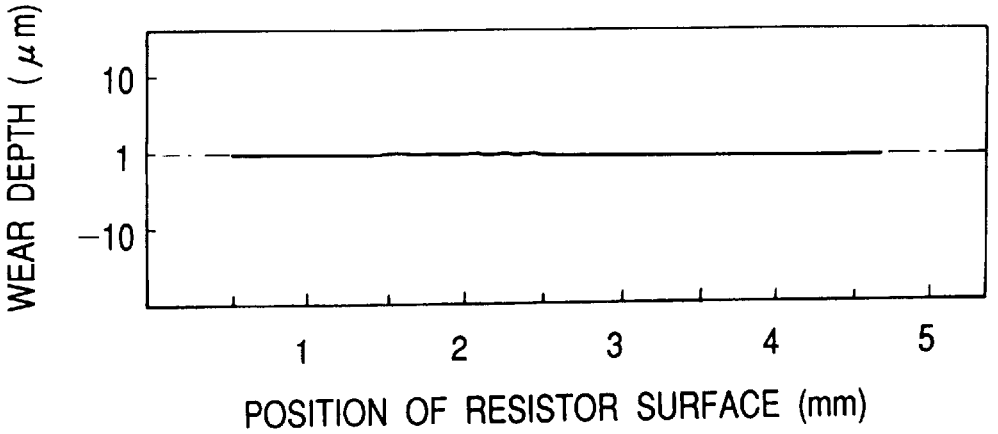
FIG. 11 PRIOR ART
FIG. 11 is a graph for describing the wear resistance of Comparative example 1.
Figure 13:
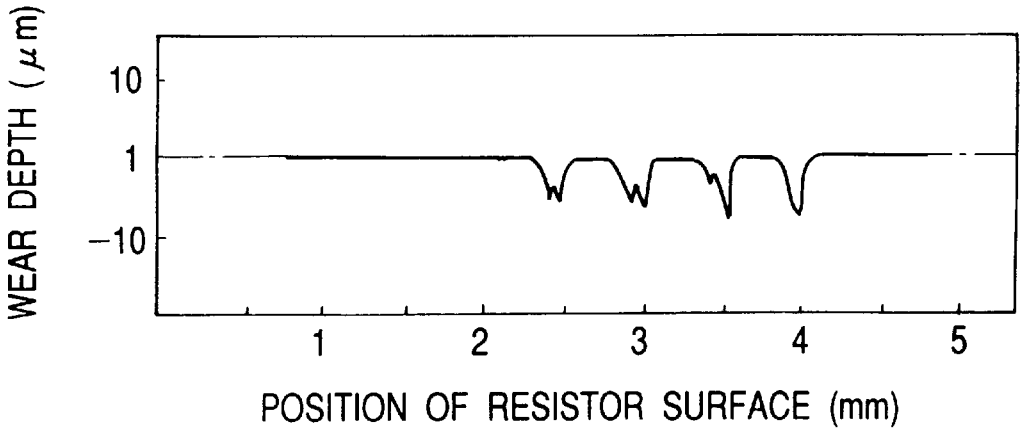
FIG. 13 PRIOR ART
FIG. 13 is a graph for describing the wear resistance of Comparative example 2.
Figure 14:
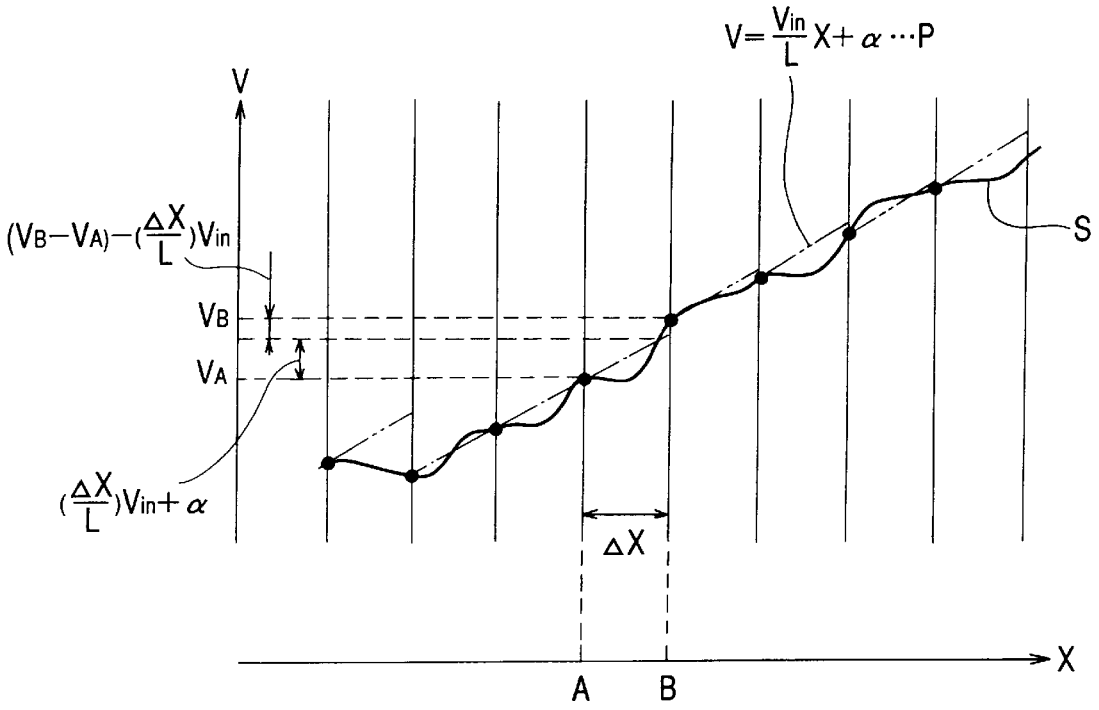
FIG. 14 is a graph for describing the micro-linearity characteristic.

FIG. 5 shows the wear resistance test result of Example 1. The horizontal axis of FIG. 5 represents the position of the resistor, and the vertical axis represents the wear depth ($\mu$m) of the surface of the resistor. 0 $\mu$m of the vertical axis shows the resistor surface before wear resistance test. In the wear resistance test, a six-component alloy brush was in contact with the resistor surface slidably, and the brush was reciprocated 400 million cycles, and then the wear of the resistor surface was observed by means of a needle contact surface roughness tester. On the other hand, the wear resistance test results of Comparative examples 1 and 2 are shown in FIG. 11 and FIG. 13 respectively. The horizontal axis and the vertical axis of FIG. 11 and FIG. 13 are the same as those of FIG. 4.

As obvious from the result described herein above, the wear resistance of Example 1 is improved significantly in comparison with Comparative example 2, and approximately equal to that of Comparative example 1 that contains much long length carbon fiber that is capable of distributing the load.

EXAMPLE 2

In Example 2 of the present invention, the resistor contains 20% by volume of carbon black and 20% by volume of carbon fiber dispersed in the same resistor base material as used in Example 1.

Figure 6:
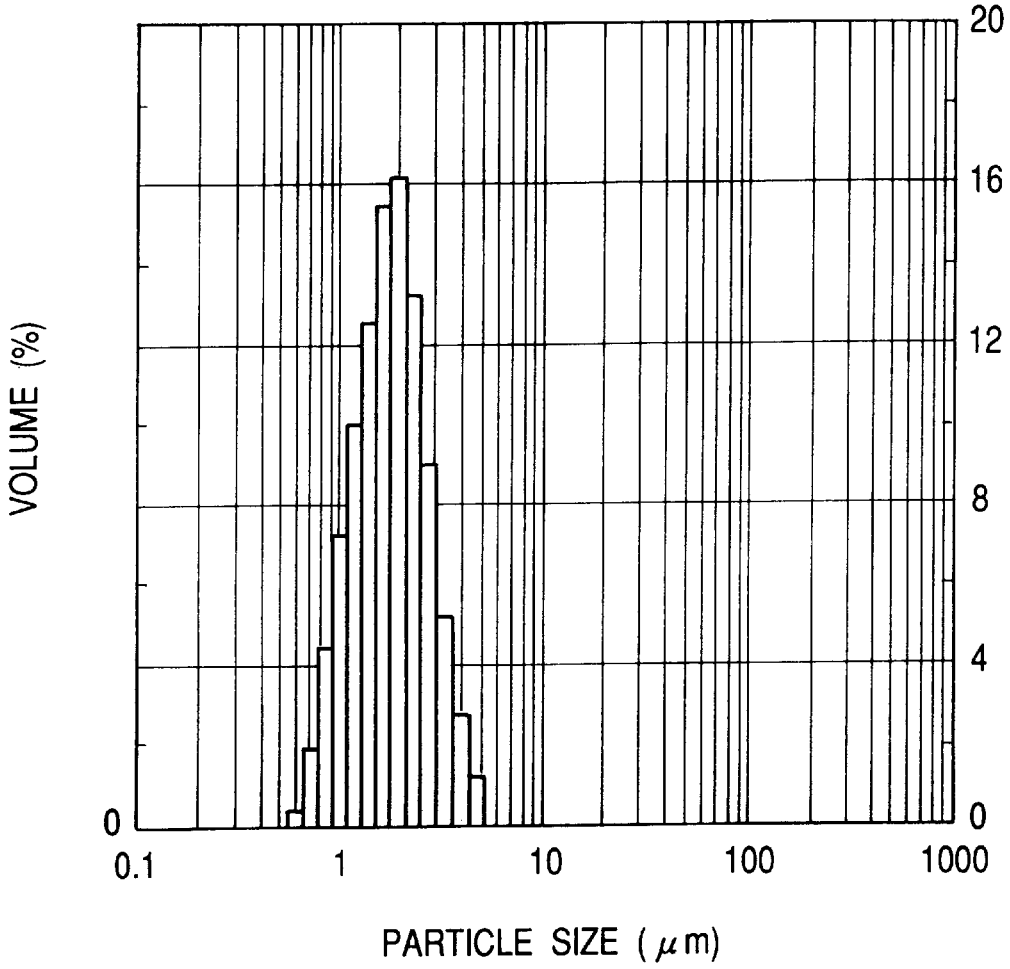
FIG. 6 is a graph for showing the particle size distribution of carbon fiber used in Example 2 of the resistor in accordance with the present invention.

The particle size distribution of ground carbon fiber used in Example 2 is shown in the graph shown in FIG. 6, which has the same coordinate axes as shown in FIG. 3. As obvious from FIG. 6, the particle size distribution of the carbon fiber used in Example 2 has a peak at a particle size of approximately 2 $\mu$m and 90% by volume of carbon fiber is included in the particulate size range from 1 to 3 $\mu$m. The carbon fiber used in Example 2 was obtained by grinding commercially available carbon fiber by means of a ball mill, at that time zirconia balls having the diameter from 5 to 10 mm were charged together with commercially available carbon fiber in a zirconia pot having a diameter of 100 to 200 mm and the ball mill was operated at a rotation speed of 60 to 150 rpm for 70 to 100 hr.

Figure 7:
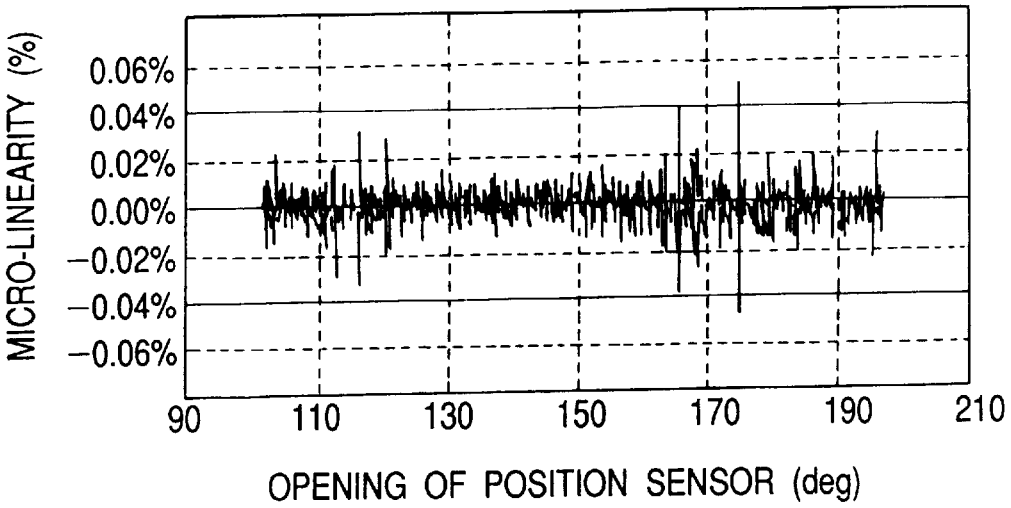
FIG. 7 is a graph for describing the micro-linearity characteristic of Example 2 of the resistor in accordance with the present invention.

The micro-linearity characteristic of the resistor used in Example 2 is shown in FIG. 7 having the same coordinate axes as shown in FIG. 4. As obvious from FIG. 7, the micro-linearity characteristic shown in FIG. 7 is significantly improved in comparison with Comparative example 1, and approximately equal to that of Comparison example 2 involving the resistor that contains no carbon fiber.

Figure 8:
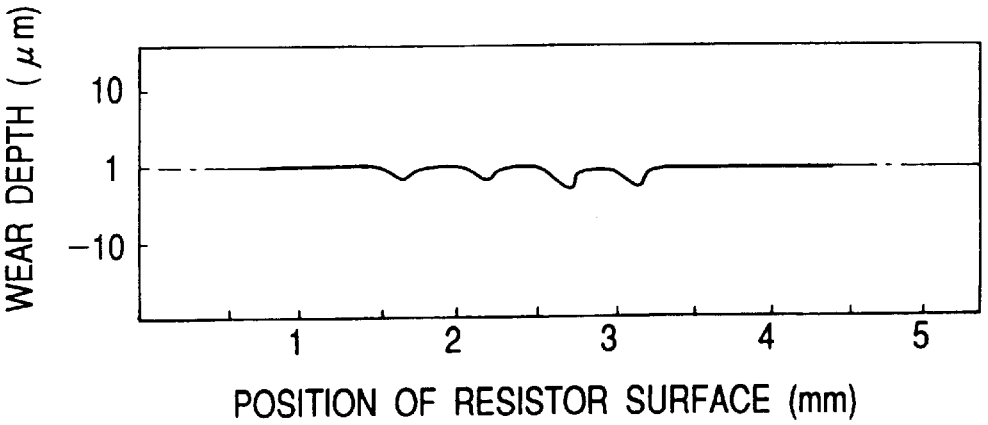
FIG. 8 is a graph for describing the wear resistance of the resistor of Example 2 of the present invention.

The result of wear resistance test on Example 2 carried out under the same condition as applied in Example 1 is shown in FIG. 8 having the same coordinate axes as shown in FIG. 5. The wear resistance of Example 2 is significantly improved in comparison with Comparative example 2, and slightly inferior to Comparative example 1. The reason is likely that the long length carbon fiber contributes to distribution of the load for supporting in Comparative example 1, on the other hand the carbon fiber of Example 2 supports the load inferiorly due to granular configuration of the carbon fiber. However, because the micro-linearity characteristic of Example 2 is significantly improved in comparison with Comparison example 1, the total performance is improved.

In the resistor in accordance with the present invention, carbon black and carbon fiber having a prescribed configuration are dispersed in resistor base material, the excellent wear resistance of carbon fiber is exhibited together with the excellent micro-linearity characteristic.

In another resistor of the present invention, because carbon black and ground carbon particles having a prescribed configuration are dispersed in resistor base material, the excellent wear resistance is exhibited together with the excellent micro-linearity characteristic.

Because the variable resistor of the present invention uses the above-mentioned resistor of the present invention, the variable resistor has a desired micro-linearity characteristic and wear resistance. Because the performance is effective in a wide environmental temperature range, the variable resistor is suitably used for various sensors to be mounted on vehicles.

What is claimed is:

1. A resistor containing 15 to 20% by volume of carbon black and 15 to 20% by volume of carbon fiber in resistor base material, wherein the particle size distribution of the carbon fiber is approximately equal to the normal distribution and not less than 80% by volume carbon fiber of the whole carbon fiber is included in the particle size range from 1 to 20 $\mu$m.

2. The resistor according to claim 1, wherein the particle size distribution of the carbon fiber has a peak in the particle size range from 1 to 3 $\mu$m.

3. The resistor according to claim 1, wherein the particle size distribution of the carbon fiber has a peak in the particle size range from 6 to 10 $\mu$m.

4. The resistor according to claim 3, wherein the carbon fiber is subjected to coupling treatment with a coupling agent.

5. A variable resistor that uses the resistor according to claim 1.

* * * * *